US011982490B1

(12) United States Patent
McLean et al.

(10) Patent No.: US 11,982,490 B1
(45) Date of Patent: May 14, 2024

(54) MEDICAL TRANSPORT CONTAINER

(71) Applicants: Mark-Anthony McLean, Freeport, NY (US); Audrey Angela McLean, Freeport, NY (US)

(72) Inventors: Mark-Anthony McLean, Freeport, NY (US); Audrey Angela McLean, Freeport, NY (US)

( * ) Notice: Subject to any disclaimer, the term of this patent is extended or adjusted under 35 U.S.C. 154(b) by 633 days.

(21) Appl. No.: 17/164,929

(22) Filed: Feb. 2, 2021

Related U.S. Application Data

(63) Continuation-in-part of application No. 16/037,390, filed on Jul. 17, 2018, now Pat. No. 10,932,989.

(51) Int. Cl.

| | |
|---|---|
| ***F25D 3/08*** | (2006.01) |
| ***B65D 25/06*** | (2006.01) |
| ***F25D 11/00*** | (2006.01) |
| ***F25D 29/00*** | (2006.01) |

(52) U.S. Cl.
CPC ..... *F25D 3/08* (2013.01); *B65D 25/06* (2013.01); *F25D 11/003* (2013.01); *F25D 29/00* (2013.01); *F25D 2303/0822* (2013.01); *F25D 2331/804* (2013.01); *F25D 2400/361* (2013.01); *F25D 2700/12* (2013.01)

(58) Field of Classification Search
CPC ..... F25D 3/08; F25D 11/003; F25D 29/00; F25D 2303/0822; F25D 2331/804; F25D 2400/361; F25D 2700/12; F25D 2303/082; F25D 2303/0844; B65D 25/06; B65D 5/48038; B65D 5/4295; A61J 1/165
See application file for complete search history.

(56) References Cited

U.S. PATENT DOCUMENTS

| | | | | |
|---|---|---|---|---|
| 4,635,810 A * | 1/1987 | Tate | B65D 5/48038 206/427 |
| 8,539,790 B1 * | 9/2013 | Budd | A01N 1/0252 62/457.9 |
| 2018/0009588 A1 * | 1/2018 | Grogan | B65D 81/18 |

FOREIGN PATENT DOCUMENTS

| | | | | |
|---|---|---|---|---|
| WO | WO2017/044934 | * | 3/2017 | F25D 3/06 |

* cited by examiner

*Primary Examiner* — Cassey D Bauer
(74) *Attorney, Agent, or Firm* — Kyle A. Fletcher, Esq.

(57) ABSTRACT

The medical transport container may be a portable briefcase-like container for transporting a medical cargo that requires refrigeration. As non-limiting examples, the medical cargo may be blood samples or pharmaceuticals. The medical transport container may be adapted to be carried by a courier using one hand. The medical cargo may be carried within an interior cavity of a case which is cooled using dry ice, a plurality of gel packs, a refrigeration unit, or combinations thereof. The interior cavity may be compartmentalized using a plurality of dividers. The temperature of the interior cavity may be monitored by a controller which may share status with and be remotely controlled by a smart device of the courier.

18 Claims, 5 Drawing Sheets

MEDICAL TRANSPORT CONTAINER

CROSS REFERENCES TO RELATED APPLICATIONS

This non-provisional patent application is a continuation-in-part of U.S. application Ser. No. 16/037,390, filed Jul. 17, 2018 by the applicants Mark-Anthony McLean and Audrey Angela McLean.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of medical cargo transportation, more specifically, a medical transport container.

SUMMARY OF INVENTION

The medical transport container may be a portable briefcase-like container for transporting a medical cargo that requires refrigeration. As non-limiting examples, the medical cargo may be blood samples or pharmaceuticals. The medical transport container may be adapted to be carried by a courier using one hand. The medical cargo may be carried within an interior cavity of a case which is cooled using dry ice, a plurality of gel packs, a refrigeration unit, or combinations thereof. The interior cavity may be compartmentalized using a plurality of dividers. The temperature of the interior cavity may be monitored by a controller which may share status with and be remotely controlled by a smart device of the courier.

An object of the invention is to provide a hand-held, portable case for transporting a medical cargo that requires refrigeration.

Another object of the invention is to provide a refrigeration unit within the case to maintain an internal temperature of the container.

A further object of the invention is to a provide a plurality of dividers for reconfiguring the interior space into a plurality of sub compartments wherein the dividers comprise a plurality of airflow apertures.

Yet another object of the invention is to a controller that may wirelessly communicate with a smart device for remote status and control of the invention.

These together with additional objects, features and advantages of the medical transport container will be readily apparent to those of ordinary skill in the art upon reading the following detailed description of the presently preferred, but nonetheless illustrative, embodiments when taken in conjunction with the accompanying drawings.

In this respect, before explaining the current embodiments of the medical transport container in detail, it is to be understood that the medical transport container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the medical transport container.

It is therefore important that the claims be regarded as including such equivalent construction insofar as they do not depart from the spirit and scope of the medical transport container. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
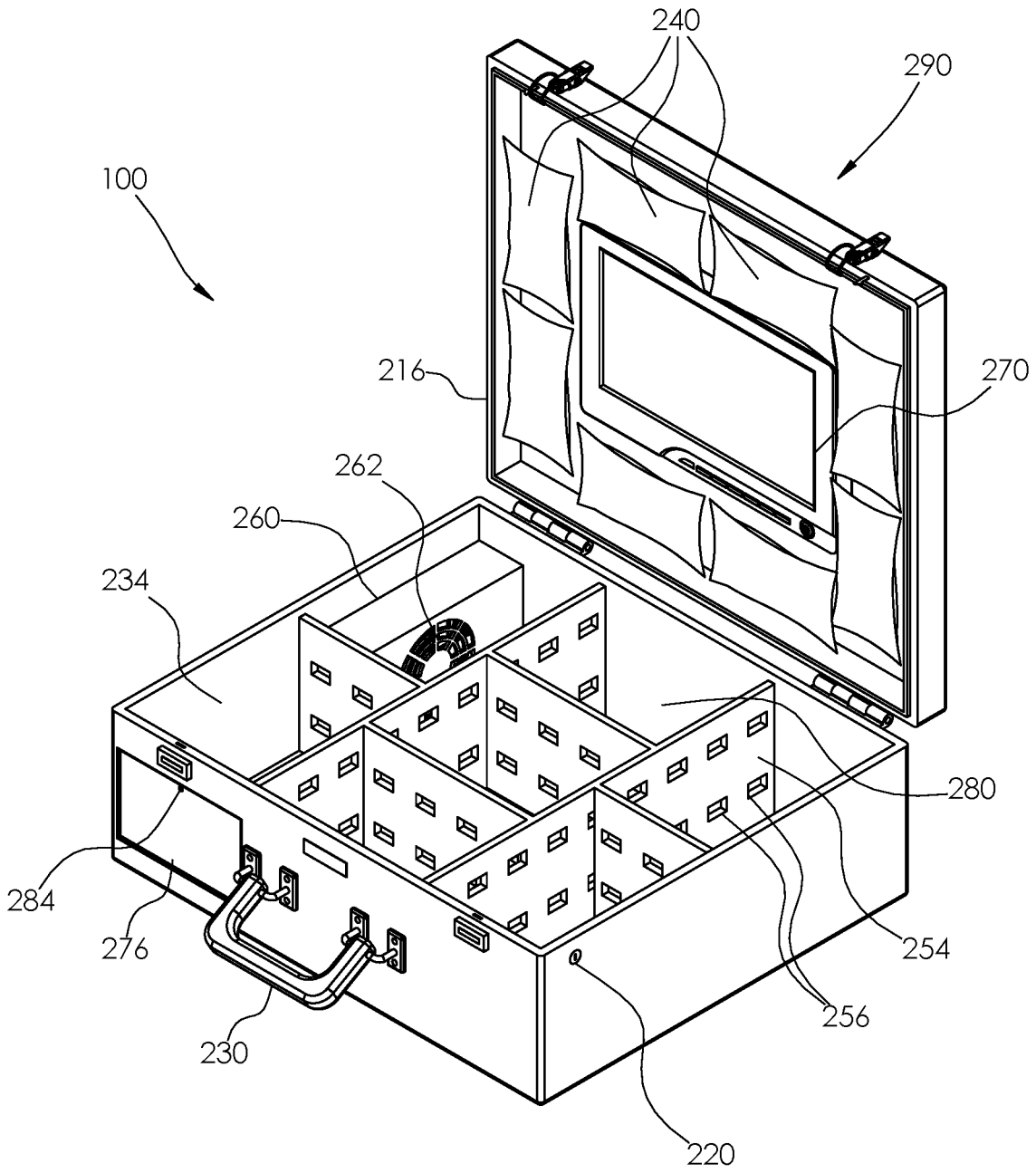
FIG. 1 is an isometric view of an embodiment of the disclosure illustrating the case in the lid open position.
Figure 2:
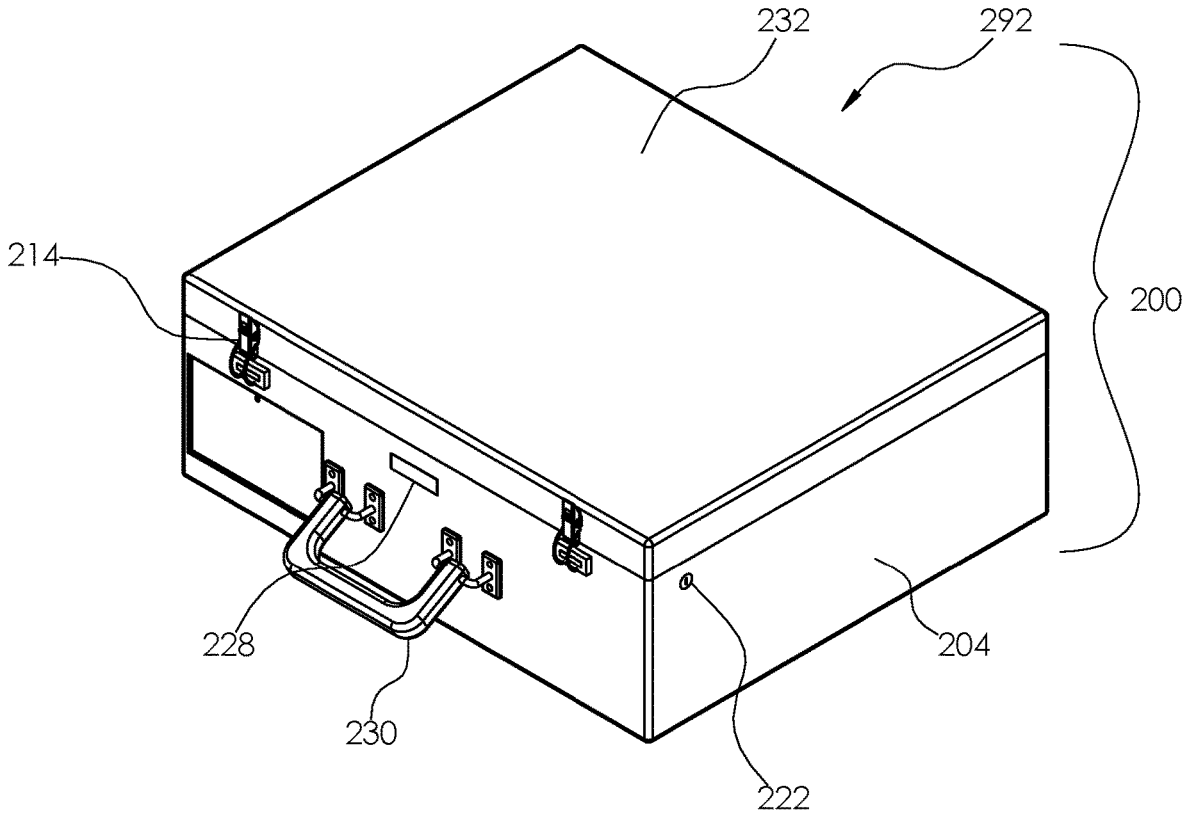
FIG. 2 is an isometric view of an embodiment of the disclosure illustrating the case in the lid closed position.
Figure 3:
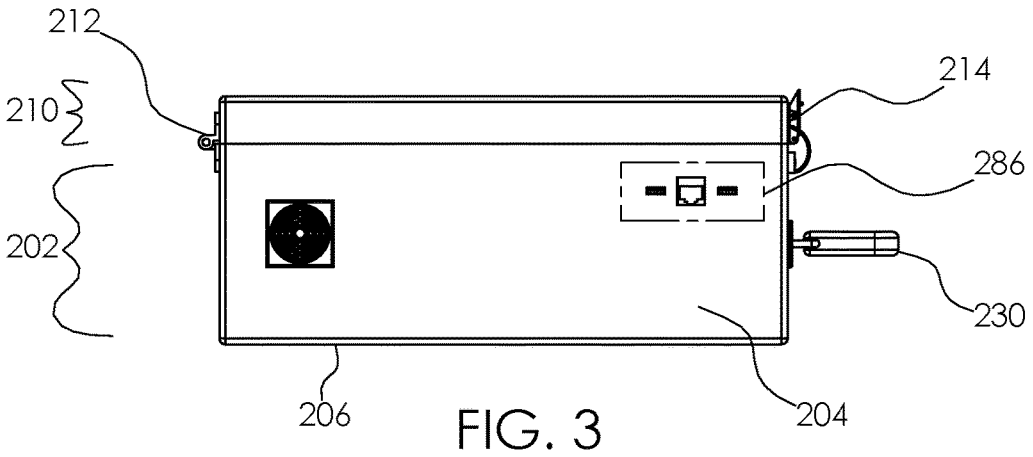
FIG. 3 is a left side view of an embodiment of the disclosure.
Figure 4:
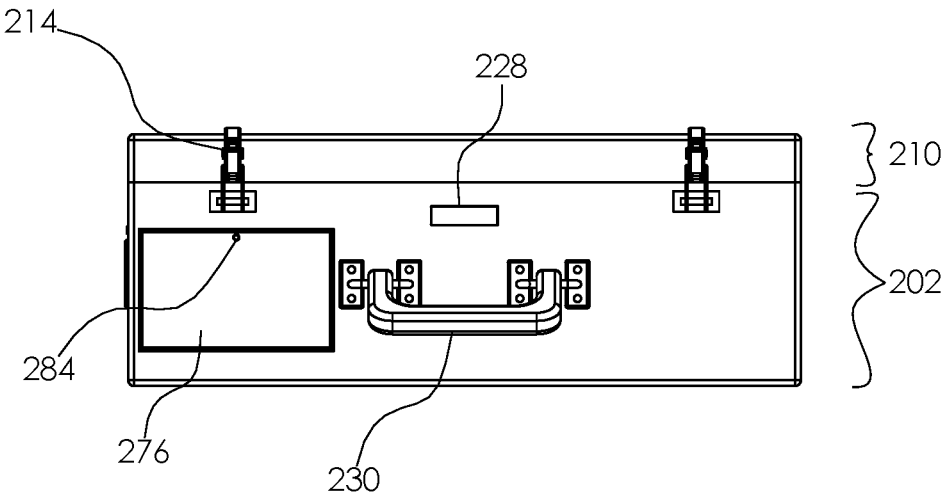
FIG. 4 is a front view of an embodiment of the disclosure.
Figure 5:
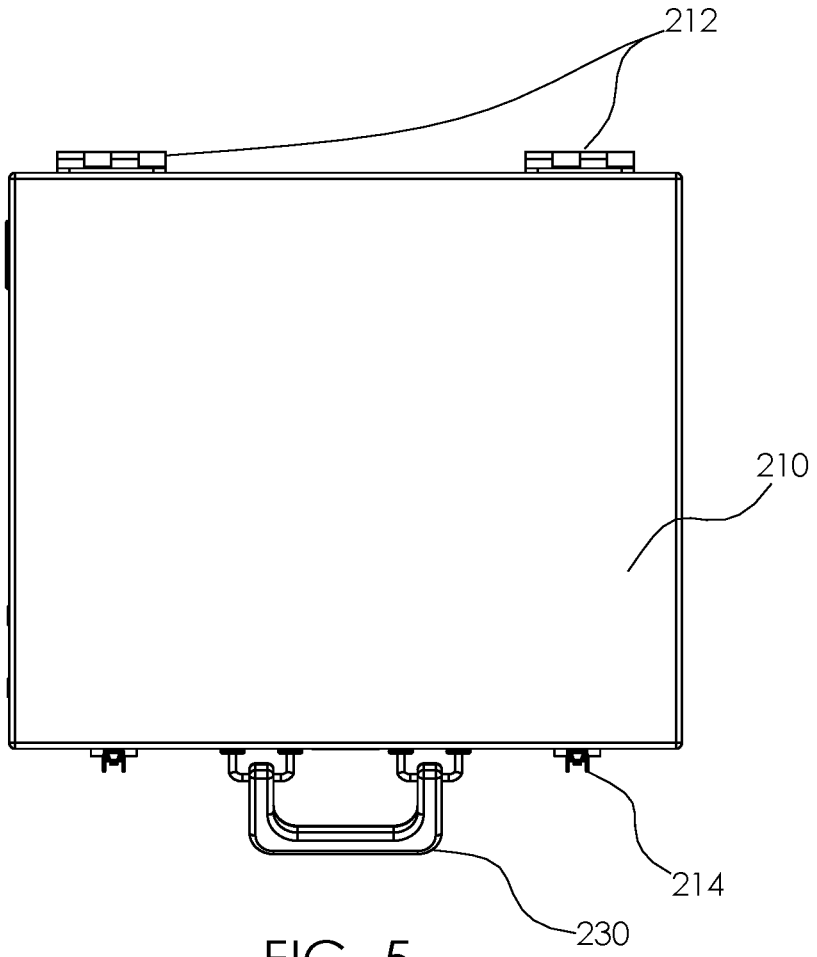
FIG. 5 is a top view of an embodiment of the disclosure illustrating the case in the lid open position.
Figure 6:
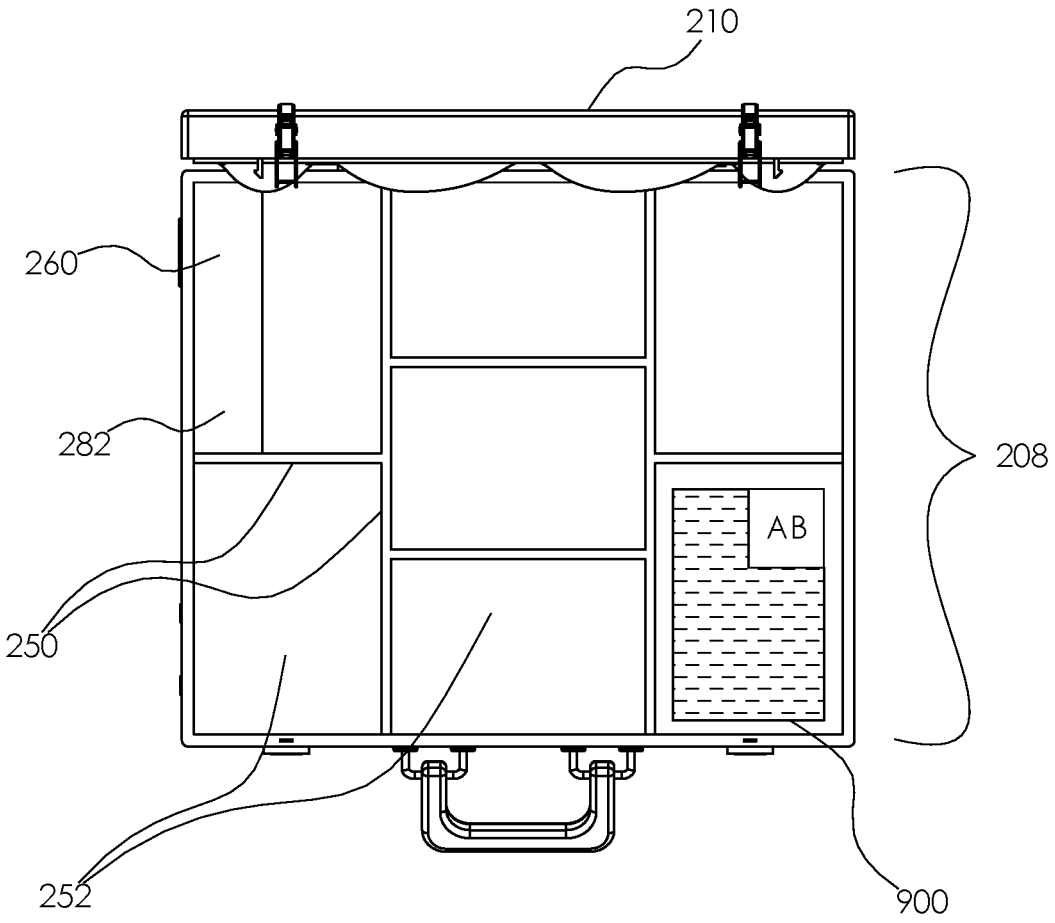
FIG. 6 is a top view of an embodiment of the disclosure illustrating the case in the lid closed position.
Figure 7:
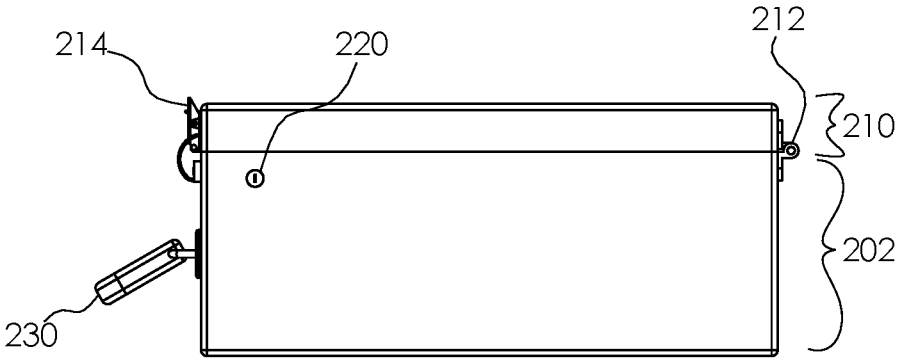
FIG. 7 is a right side view of an embodiment of the disclosure.
Figure 8:
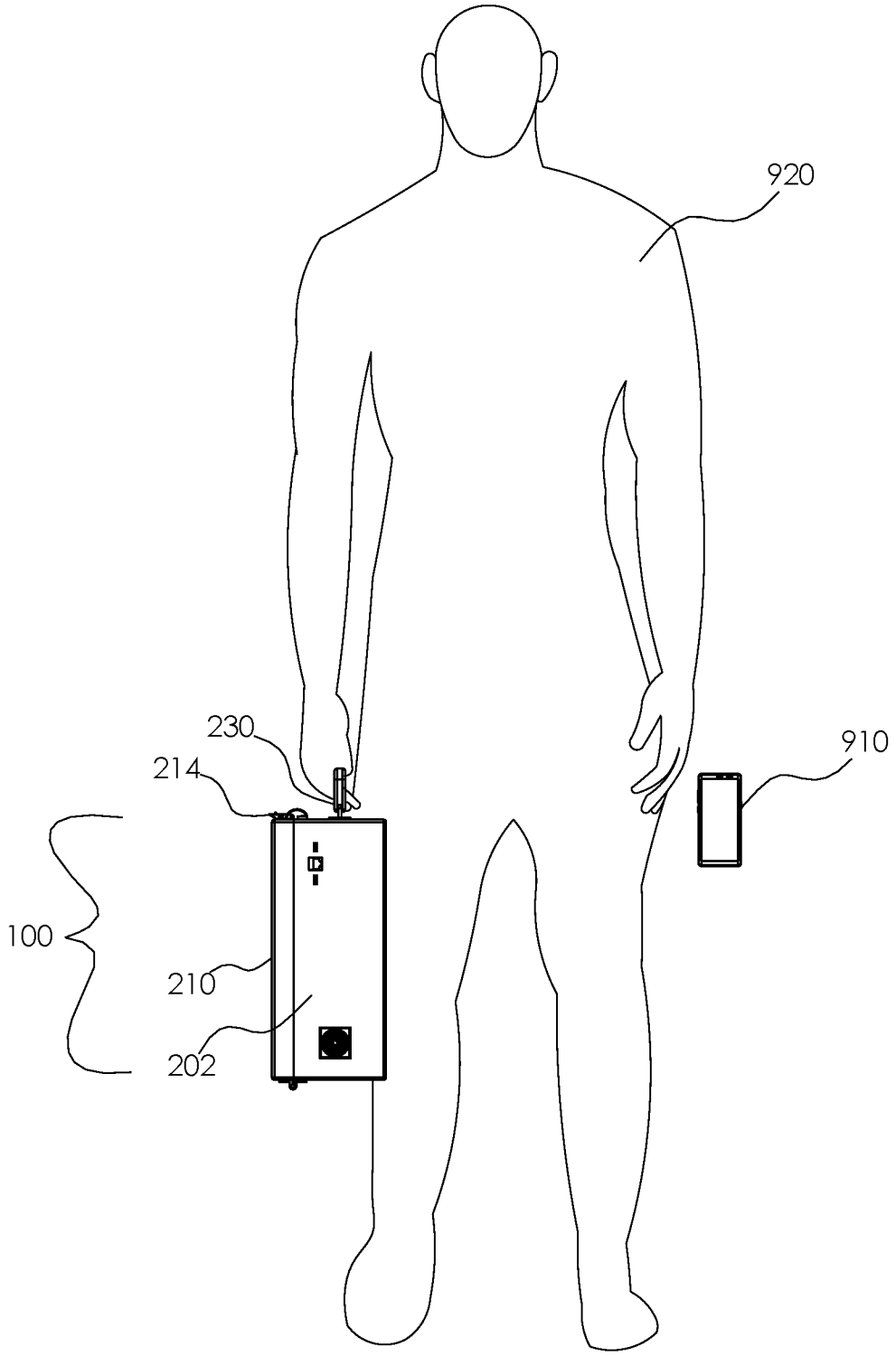
FIG. 8 is an in-use view of an embodiment of the disclosure.

Detailed reference will now be made to a first potential embodiment of the disclosure, which is illustrated in FIGS. 1 through 8.

The medical transport container 100 (hereinafter invention) may be a portable briefcase-like container for transporting a medical cargo 900 that requires refrigeration. As non-limiting examples, the medical cargo 900 may be blood samples or pharmaceuticals. The invention 100 may be adapted to be carried by a courier 920 using one hand. The medical cargo 900 may be carried within an interior cavity 208 of a case 200 which is cooled using dry ice, a plurality of gel packs 240, a refrigeration unit 260, or combinations thereof. The interior cavity 208 may be compartmentalized using a plurality of dividers 250. The temperature of the interior cavity 208 may be monitored by a controller 270 which may share status with and be remotely controlled by a smart device 910 of the courier 920.

The case 200 may comprise a case body 202, a case lid 210, and a carry handle 230. The case 200 may provide a housing for the medical cargo 900 and may retain an internal temperature which may be different from an ambient temperature outside of the case 200. The case body 202 may comprise a plurality of side walls 204 coupled to a bottom wall 206 to define the interior cavity 208.

The case lid 210 may hingedly couple to the case body 202 via one or more hinges 212 such that the case lid 210 may pivot between a lid open position 290 and a lid closed position 292. The interior cavity 208 may be covered and inaccessible when the case lid 210 is in the lid closed position 292. The interior cavity 208 may be accessible for placing or removing the medical cargo 900 when the case lid 210 is in the lid open position 290. The case lid 210 may be held in the lid closed position 292 by one or more latches 214. In some embodiments, a seal 216 may prevent air leakage at the boundary between the case lid 210 and the case body 202.

The case 200 may comprise one or more locks 220 such that unauthorized access to the medical cargo 900 may be prevented. The one or more locks 220 may prevent the case lid 210 from separating from the case body 202 unless all of the one or more locks 220 are in an unlocked state. In some embodiments, the one or more locks 220 may comprise one or more keyed locks 222. An individual keyed lock selected form the one or more keyed locks 222 may require a key to lock and unlock the individual keyed lock.

In some embodiments, the one or more locks 220 may comprise a digital lock 228. The digital lock 228 may require entry of a sequence of digits using a keypad in order to unlock the digital lock 228.

The carry handle 230 may be pivotably coupled to the case body 202 at the center of one of the plurality of side walls 204 opposite the one or more hinges 212. The carry handle 230 may be adapted to serve as a grasping point for the courier 920 while transporting the case 200.

In some embodiments, the case 200 may comprise an exterior finish 232. The exterior finish 232 may enhance the waterproofing characteristics of the case 200 and/or may cushion the case 200 from impacts. As non-limiting examples, the exterior finish 232 may be natural or synthetic leather, vinyl, nylon, durable fabric, or combinations thereof.

The case body 202 and the case lid 210 may be insulated to maintain the internal temperature as low as possible for as long as possible. The plurality of side walls 204, the bottom wall 206, and the case lid 210 may comprise insulation 234 as a thermal barrier. As a non-limiting example, the insulation 234 may comprise a layer sandwiched between the inside surface and the outside surface of the plurality of side walls 204 the bottom wall 206, and the case lid 210. Alternatively, the insulation 234 may comprise the inner surface of the plurality of side walls 204 the bottom wall 206, and the case lid 210.

The interior cavity 208 may be cooled by dry ice, by the plurality of gel packs 240, by the refrigeration unit 260, or by a combination thereof. The plurality of gel packs 240 may be frozen prior to use. The plurality of gel packs 240 may be removably coupled to the interior of the case lid 210. The plurality of gel packs 240 may press down on the medical cargo 900 from above to prevent the medical cargo 900 from shifting.

The plurality of dividers 250 may be operable to separate the interior cavity 208 into a plurality of sub compartments 252. The plurality of sub compartments 252 may be operable to support the medical cargo 900 and to reduce the probability of damage to the medical cargo 900. In some embodiments, the plurality of dividers 250 may comprise multiple sizes and may be reconfigurable such that the plurality of sub compartments 252 may be adapted to match the size of the medical cargo 900 placed into each of the plurality of sub compartments 252.

In some embodiments, an individual divider 254 selected from the plurality of dividers 250 may comprise a plurality of airflow apertures 256. The plurality of airflow apertures 256 in the individual dividers 254 may be operable to permit circulation of air within the interior cavity 208 such that hot spots are prevented from developing.

The refrigeration unit 260 may release cold air into the interior cavity 208 via a cold air vent 262. The refrigeration unit 260 may produce the cold air using mechanical refrigeration technology, thermo-electric refrigeration technology, or combinations thereof.

The controller 270 may be a microprocessor circuit executing computer software specific to the invention 100 and operable to control the overall operation of the invention 100. As non-limiting examples, the controller 270 may monitor the internal temperature in the case 200 via one or more temperature sensors 280, may energize and deenergize the refrigeration unit 260, may display the internal temperature and other status on a touch sensitive display 276, and may communicate with the smart device 910 and other external devices via one or more wireless transceivers and one or more connectivity ports 286.

The touch sensitive display 276 may be accessible on the outside of the case 200 such that status may be monitored and set points changed without opening the case lid 210. In addition, any information and functions that may be accessible via the touch sensitive display 276 may also be accessible on the smart device 910 via a wireless communication link between the one or more wireless transceiver and the smart device 910.

In some embodiments, the invention 100 may comprise a camera 284 accessible on the exterior of the case 200. The camera 284 may be operable to capture images and/or video that may be stored and/or transmitted to the smart device 910.

The invention 100 may be powered by one or more batteries 282. The one or more batteries 282 may comprise one or more energy-storage devices. The one or more batteries 282 may be a source of electrical energy to operate the controller 270, the refrigeration unit 260, the touch sensitive display 276, and other electronics. The one or more batteries 282 may be replaceable or rechargeable.

In use, the case lid 210 may be opened and the medical cargo 900 may be placed into the plurality of sub compartments 252 located within the case body 202. Dry ice may be packed around the medical cargo 900 if desired. The plurality of gel packs 240 which have been frozen may be coupled to the inside of the case lid 210 such that the plurality of gel packs 240 may cover the medical cargo 900 when the case lid 210 is closed. The case lid 210 may be closed, latched and locked. The controller 270 may be instructed to maintain the internal temperature via the touch sensitive display 276. The case 200 may be transported to move the medical cargo 900 to a destination. During the transfer, the controller 270 may activate the refrigeration unit 260 if necessary to maintain the internal temperature. Status and alert notifications may be displayed on the touch sensitive display 276 and on the smart device 910 of the courier 920.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "boundary" may refer to a line segment or surface that forms a some or all of the perimeter of a first space and some or all of the perimeter of a second space. Stated less formally, the boundary forms at least part of the delineation between the first space and the second space. When identifying a boundary within this disclosure, a first space may be said to "be bounded" by one or more additional spaces.

As used in this disclosure, a "camera" may be a sensor that converts light into electric signals that encode the spatial orientation of the captured light in a manner that reproduces the images seen by a human eye.

As used in this disclosure, "cargo" may refer to one or more objects that are intended to be transported using a vehicle.

As used in this disclosure, a "cavity" may be an empty space or negative space that is formed within an object.

As used herein, the words "couple", "couples", "coupled" or "coupling", may refer to connecting, either directly or indirectly, and does not necessarily imply a mechanical connection.

As used in this disclosure a "cushion" may be a structure formed from a pad that is used to prevent injury or damage to a person or object.

As used herein, the words "data" and "information" may be used interchangeably to refer to raw, unprocessed facts and to facts that have been processed, structured, organized, or presented in a context that makes the facts useful.

As used in this disclosure, a "display" may be a surface upon which is presented an image, potentially including, but not limited to, graphic images and text, that is interpretable by an individual viewing the image. When used as a verb, "display" may be defined as presenting such an image.

As used herein, "energize" and/or "energization" may refer to the application of an electrical potential to a system or subsystem.

As used in this disclosure, the word "exterior" may be used as a relational term that implies that an object is not located or contained within the boundary of a structure or a space.

As used herein, "handle" may refer to an object by which a tool, object, or door is held or manipulated with the hand.

As used in this disclosure, a "housing" may be a rigid or semi-rigid casing that encloses and protects one or more devices.

As used in this disclosure, the word "interior" may be used as a relational term that implies that an object is located or contained within the boundary of a structure or a space.

As used in this disclosure, a "laptop computer" may be a computer that incorporates into a single housing: 1) a mechanism to provide tactile inputs; 2) a mechanism to provide visual and audio outputs; 3) a mechanism to receive digital or analog inputs from an external mechanical device; and, 4) a mechanism to provide digital or analog outputs to an external mechanical device. The single housing is sized such that the laptop computer can be transported by a single person.

As used in this disclosure, a "lid" may be a movable or removable cover that is placed on a hollow structure to contain and/or protect the contents within the hollow structure.

As used herein, "mechanical refrigeration" may refer to refrigeration using a mechanical compressor to implement a cycle of evaporation and condensation of a refrigerant within a sealed system.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used herein, the word "portable" may refer to a device that may be carried by a single person and may be used at multiple locations. In some cases, portable may imply that the device may be used while being carried.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used herein, "smart device" may refer to a portable electrical device comprising at least a processor, display, input device, and network connection. The input device is generally a touch screen, keyboard, or voice recognition. The network connection is generally wireless. Non-limiting examples of smart devices may include smartphones, tablets, personal digital assistants, laptop computers, and smartwatches.

As used herein, "smart phone" or "smartphone" may refer to a personal communication device that incorporates cellular phone calling and texting capabilities along with advanced features. Non-limiting examples of the advanced features of a smart phone may include camera functions, multimedia functions (such as music and video recording and playback and gaming), internet functions (such as web browsing and file uploading/downloading), and Global Positioning System capabilities. A smartphone may be able to execute downloaded application programs that expand the capabilities of the smartphone.

As used herein, a "tablet computer" or "tablet" may refer to a mobile computing device packaged as a single, monolithic unit—similar in appearance to a paper tablet. Typically, tablet computers have a touch sensitive, flat video display covering most of the front surface and do not have a keyboard; although many tablet computers may be mated with a separate keyboard accessory. Tablet computers generally comprise one or more microprocessors, memory, and a rechargeable battery internal to the tablet. Most tablet computers comprise a wireless network connection, typically via a WiFi interface. Many tablet computers comprise an internal camera, microphone, and one or more audio speakers. Interaction between the user and a tablet computer is generally via the touch screen using a stylus or fingers and may involve the use of 'gestures' which are specific motions on the touch screen which are interpreted by the tablet computer to magnify or shrink the display, open, close, or switch between applications, scroll, or perform other tablet computer functions.

As used in this disclosure, a "transceiver" may be a device that is used to transmit and/or receive signals. The signals may be audible, optical, or RF in nature.

As used in this disclosure, "wireless" may be an adjective that is used to describe a communication channel that does not require the use of physical cabling.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A medical transport container wherein the medical transport container is a portable container for transporting a medical cargo that requires refrigeration;

wherein the medical cargo is carried within an interior cavity of a case which is cooled;

wherein the interior cavity is compartmentalized using a plurality of dividers;

wherein the temperature of the interior cavity is monitored by a controller which shares status with and be remotely controlled by a smart device of a courier;

wherein the case comprises a case body, a case lid, and a carry handle;

wherein the case lid hingedly couples to the case body via one or more hinges such that the case lid pivots between a lid open position and a lid closed position;

wherein the medical transport container comprises a camera accessible on an exterior of the case;

wherein the camera is operable to capture images and/or video that are stored and/or transmitted to the smart device.

2. The medical transport container according to claim 1 wherein the case provides a housing for the medical cargo and retains an internal temperature which are different from an ambient temperature outside of the case;

wherein the case body comprises a plurality of side walls coupled to a bottom wall to define the interior cavity.

3. The medical transport container according to claim 2;

wherein the interior cavity is covered and inaccessible when the case lid is in the lid closed position;

wherein the interior cavity is accessible for placing or removing the medical cargo when the case lid is in the lid open position;

wherein the case lid is held in the lid closed position by one or more latches.

4. The medical transport container according to claim 3 wherein a seal prevents air leakage at the boundary between the case lid and the case body;

wherein the interior is cooled using dry ice, a plurality of gel packs, a refrigeration unit, or combinations thereof.

5. The medical transport container according to claim 4 wherein the case comprises one or more locks to prevent unauthorized access to the medical cargo;

wherein the one or more locks prevent the case lid from separating from the case body unless all of the one or more locks are in an unlocked state.

6. The medical transport container according to claim 5 wherein the one or more locks comprise one or more keyed locks;

wherein an individual keyed lock selected from the one or more keyed locks requires a key to lock and unlock the individual keyed lock.

7. The medical transport container according to claim 5 wherein the one or more locks comprise a digital lock;

wherein the digital lock requires entry of a sequence of digits using a keypad in order to unlock the digital lock.

8. The medical transport container according to claim 5 wherein the carry handle is pivotably coupled to the case body at the center of one of the plurality of side walls opposite the one or more hinges;

wherein the carry handle is adapted to serve as a grasping point for the courier while transporting the case.

9. The medical transport container according to claim 8 wherein the case body and the case lid are insulated to maintain the internal temperature;

wherein the plurality of side walls, the bottom wall, and the case lid comprise insulation as a thermal barrier.

10. The medical transport container according to claim 9 wherein the interior cavity is cooled by dry ice, by the plurality of gel packs, by the refrigeration unit, or by a combination thereof;

wherein the plurality of gel packs are frozen prior to use;

wherein the plurality of gel packs are removably coupled to the interior of the case lid;

wherein the plurality of gel packs press down on the medical cargo from above to prevent the medical cargo from shifting.

11. The medical transport container according to claim 10 wherein the plurality of dividers are operable to separate the interior cavity into a plurality of sub compartments;

wherein the plurality of sub compartments are operable to support the medical cargo and to reduce the probability of damage to the medical cargo.

12. The medical transport container according to claim 11 wherein the plurality of dividers comprise multiple sizes and are reconfigurable such that the plurality of sub compartments are adapted to match the size of the medical cargo placed into each of the plurality of sub compartments.

13. The medical transport container according to claim 11 wherein an individual divider selected from the plurality of dividers comprises a plurality of airflow apertures;

wherein the plurality of airflow apertures in the individual dividers are operable to permit circulation of air within the interior cavity such that hot spots are prevented from developing.

14. The medical transport container according to claim 13 wherein the refrigeration unit releases cold air into the interior cavity via a cold air vent;

wherein the refrigeration unit produces the cold air using mechanical refrigeration technology, thermo-electric refrigeration technology, or combinations thereof.

15. The medical transport container according to claim 14 wherein the controller is a microprocessor circuit executing computer software specific to the medical transport container and operable to control the overall operation of the medical transport container.

16. The medical transport container according to claim 15 wherein the controller monitors the internal temperature in the case via one or more temperature sensors, energizes and deenergizes the refrigeration unit, displays the internal temperature and other status on a touch sensitive display, and communicates with the smart device and other external devices via one or more wireless transceivers and one or more connectivity ports.

17. The medical transport container according to claim 16 wherein the touch sensitive display is accessible on the outside of the case such that status is monitored and set points changed without opening the case lid;

wherein in addition, any information and functions that are accessible via the touch sensitive display are also accessible on the smart device via a wireless communication link between the one or more wireless transceiver and the smart device.

18. The medical transport container according to claim 17 wherein the medical transport container is powered by one or more batteries;

wherein the one or more batteries comprise one or more energy-storage devices;

wherein the one or more batteries are a source of electrical energy to operate the controller, the refrigeration unit, the touch sensitive display, and other electronics;

wherein the one or more batteries are replaceable or rechargeable.

* * * * *